United States Patent [19]

Parks

[11] 4,017,137

[45] Apr. 12, 1977

[54] ELECTRICAL RACEWAY AND RECEPTACLE ASSEMBLIES

[75] Inventor: William E. Parks, Plantsville, Conn.

[73] Assignee: The Wiremold Company, West Hartford, Conn.

[22] Filed: Jan. 16, 1976

[21] Appl. No.: 649,787

[52] U.S. Cl. ..... 339/21 R; 174/48; 339/36; 339/113 L

[51] Int. Cl.[2] ..... H01R 13/60

[58] Field of Search ..... 339/20, 21 R, 21 S, 339/23, 36, 113 R, 113 L; 174/48, 49, 70 C, 72 C

[56] References Cited

UNITED STATES PATENTS

| | | | |
|---|---|---|---|
| 1,817,034 | 8/1931 | Hotchkin | 174/72 C |
| 2,244,883 | 6/1941 | Ducer | 174/70 C UX |
| 2,552,061 | 5/1951 | Popp | 339/36 |
| 2,610,999 | 9/1952 | Silver | 339/36 |
| 3,150,907 | 9/1964 | Petroske | 339/21 R X |
| 3,161,974 | 12/1964 | Blockson | 339/21 R |
| 3,634,809 | 1/1972 | Joly | 339/21 R X |

OTHER PUBLICATIONS

Wildmold; Plugmold 2000; in Electrical Construction and Maintenance, Aug. 1975, p. 35.

*Primary Examiner*—Roy Lake
*Assistant Examiner*—Howard N. Goldberg
*Attorney, Agent, or Firm*—Prutzman, Hayes, Kalb & Chilton

[57] ABSTRACT

An electrical raceway assembly having a channel-shaped cover and a plurality of receptacles mounted in the cover. A pair of cover sidewalls have free edges bent toward one another, and longitudinally extending recesses are formed in opposite sides of the receptacles in confronting relation to the free edges on the cover sidewalls to provide a pair of by-pass conductor compartments with the free edges of the cover sidewalls serving as conductor retaining jaws. This invention also discloses an electrical receptacle assembly featuring a receptacle face cap removably fitted over a raised front face of the receptacle. The face cap has projecting flanges which may be interposed between the receptacle and its cover plate to secure the face cap in overlying position on the receptacle face.

20 Claims, 6 Drawing Figures

ELECTRICAL RACEWAY AND RECEPTACLE ASSEMBLIES

This invention concerns electrical raceway and receptacle assemblies.

A primary object of this invention is to provide a new and improved multi-outlet raceway featuring significantly increased wiring capacity and quick and easy installation.

Another object of this invention is to provide such a raceway formed of a two piece, sheet metal holecut cover and matching base for snap-in assembly.

A further object of this invention is to provide a new and improved raceway having prewired receptacles and extra bypass conductors retained in assembly with only a cover of the raceway without requiring wire clips for the extra conductors for facile installation of the cover with a raceway base.

Yet another object of this invention is to provide a raceway of the type described wherein prewired receptacles may be factory installed in the raceway cover, to be snapped into a wall or bench mounted raceway base, with extra by-pass conductors being held in place within the raceway cover without undesired pinching of the extra conductors upon snap locking the cover onto the base during installation, and wherein additional by-pass conductors may be installed behind the receptacles along two corners of the raceway base.

A further object of this invention is to provide a new and improved receptacle assembly particularly designed to provide exposed faces of different appearance for distinguishing receptacles which may be wired alternately and controlled by separate switches.

Another object of this invention is to provide a new and improved receptacle assembly featuring a receptacle face cap which is easily fitted into position over the receptacle to be held in place by a cover for the receptacle and which may be easily removed if desired.

Other objects will be in part obvious and in part pointed out more in detail hereinafter.

A better understanding of this invention will be obtained from the following detailed description and the accompanying drawings of illustrative applications of this invention.

Figure 1:
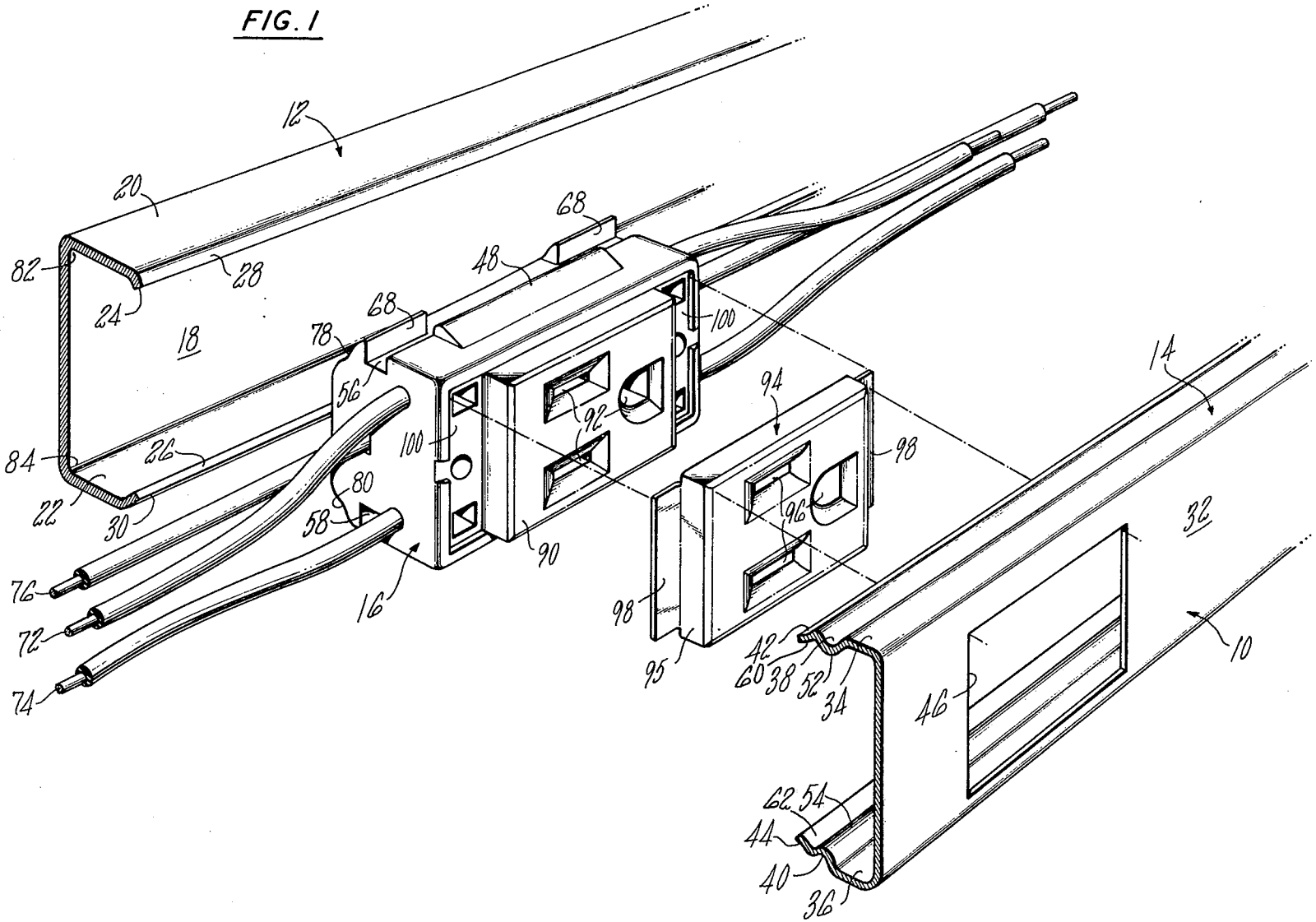
FIG. 1 is an exploded isometric view showing component parts of an attachment plug receptacle incorporating this invention.
Figure 2:
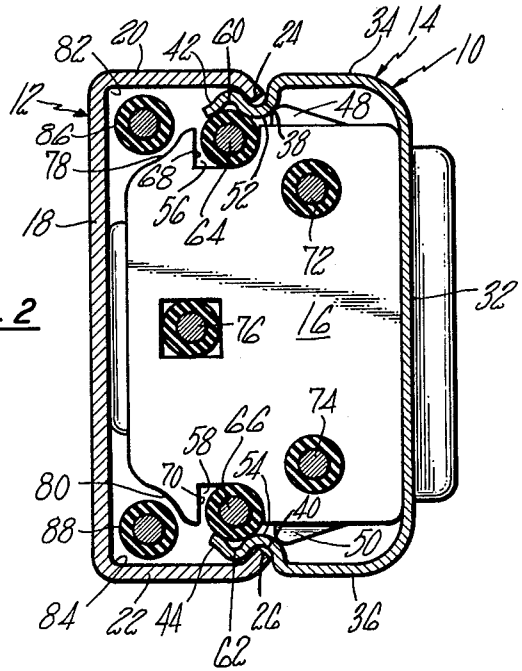
FIG. 2 is an enlarged end profile view of component parts of FIG. 1, partly broken away and partly in section, shown in assembled relation.
Figure 3:
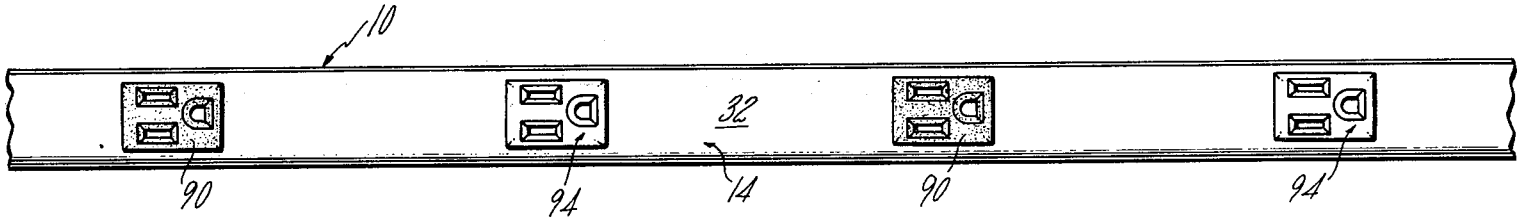
FIG. 3 is a front view, partly broken away, showing a raceway incorporating this invention.

Referring to the drawings in detail, this invention is shown incorporated in a surface mounted raceway 10.

Raceway 10 is a two piece sheet metal assembly comprising a base 12 and matching holecut cover 14. Prewired receptacles 16 are factory installed in raceway cover 14 ready to be snapped into base 12 which may be conveniently mounted on a bench or wall supporting surface, not shown. Cover 14 and base 12 are preferably formed of a suitable rugged sheet metal material capable of being easily formed and shaped but not readily bent or abused. Any suitable tough, resilient material which possesses form-sustaining rigidity upon being formed and exhibits sufficient flexibility to provide the connection upon installation as hereafter described may be used to form the assembly.

Base 12 is suited to be fastened to a wall, baseboard, or other suitable support and is shown as being channel-shaped in cross section with a flat floor 18 and opposed sidewalls 20, 22. The sidewalls 20 and 22 have free edges 24 and 26 bent inwardly toward one another to form spaced apart, longitudinally extending tongues 28 and 30.

Cover 14 is also channel-shaped in cross section with a flat front face 32 from which parallel sidewalls 34, 36 extend for cooperating interlocking engagement with longitudinally extending tongues 28, 30 of base 12. In the specifically illustrated embodiment, each cover sidewall 34 and 36 is formed with a longitudinally extending external groove 38 and 40 adjacent a reversely bent exterior lead-in lip 42 and 44 on the free end of sidewall 34 and 36, respectively.

A plug receptacle 16 is fitted into each opening 46 in the face or cover plate 32 of cover 14 and is particularly suited to be retained in assembly with cover 14 by a pair of ribs 48 and 50 projecting outwardly from opposite sides of receptacle 16 for snap-locking engagement with arcuate projections 52 and 54 on the interior of sidewalls 34 and 36, the projections being opposite the exterior recesses formed by grooves 38 and 40.

For increased wiring capacity in a compact construction also featuring increased installation convenience with minimum requirements for wire retaining clips, each receptacle 16 is formed with longitudinally extending by-pass conductor compartments 56, 58 on opposite sides of each receptacle 16 in opposed alignment to confronting interior conductor retaining jaws 60, 62 opposite the exterior lips 42, 44 of cover sidewalls 34, 36.

By virtue of this construction, receptacle 16 provides for an extra circuit "through" conductor to be fitted within each compartment 56 and 58 of the receptacle 16 and retained in position within side receptacle compartments 56, 58 by cover 14 upon snap-locking receptacle 16 into position within cover 14. I.e., the longitudinally extending lead-in lips 42, 44 on sidewalls 34, 36 of cover 14 serve to define interior jaws 60, 62 which engage and secure by-pass conductors 64, 66 within compartments 56, 58, and ledges 68, 70 cooperate with jaws 60, 62 of cover 14 to hold the by-pass conductors 64, 66 in place. Such construction eliminates pinching the conductors 64, 66 between cover and base during assembly and eliminates need for wire clips to retain these extra conductors in position.

In addition to accommodating prewired conductors 72, 74 76 and extra by-pass conductors 64, 66, the back corner edges of each receptacle 16 are removed at 78 and 80 to provide clearance along the longitudinally extending corners 82 and 84 of the base 12 between its floor 18 and sidewalls 20 and 22, thereby allowing additional conductors 86 and 88 to be fitted behind each receptacle 16 adjacent the floor 18 of the base 12 to maximize the number of by-pass conductors accommodated in the disclosed raceway.

Accordingly, it will be seen that the prewired receptacles, with the extra conductors 64 and 66 operatively mounted between receptacle 16 and cover 14, may be quickly and easily assembled with two additional bypass or through conductors 86, 88 extending along the corners 82, 84 of the base 12 to be retained by the receptacles 16 upon assembling the base 12 and cover 14. If necessary, wire clips, not shown, may be used to assist in retaining additional conductors 86 and 88 in the corners 82 and 84 of the base 12. Significant savings of material in the manufacture of the disclosed raceway is achieved, and assembly time is minimized, without danger of the conductors 64, 66 being pinched during installation between cover and base.

In accordance with yet another aspect of this invention, an improved electrical receptacle assembly is provided. More specifically, receptacle 16 is shown as being generally rectangular in configuration and has a raised face 90 with attachment plug prong-receiving openings illustrated at 92. The receptacle cover plate 32 has a plurality of openings 46 each of which is complementary to each receptacle face 90 for receiving the same in assembled relation upon securing the receptacles 16 within cover 14.

To provide aesthetic and practical alternatives to enable the multi-outlet raceway 10 to be used to distinguish a series of receptacles 16 which may be wired alternately and controlled by separate switches, a face cap 94 is provided having plug prong-receiving openings 96 matching those in receptacle face 90. A depending skirt 95 extends around the edges of cap 94. This face cap 94 is dimensioned and configured to removably fit onto the receptacle face 90 in overlying relation with the face and skirt 95 of cap 94 enclosing the raised receptacle face 90. The receptacle cover plate opening 46 is dimensioned and configured to receive either the receptacle face 90 alone, or, alternatively, both the receptacle face 90 and its overlying face cap 94 mounted in position on face 90.

To secure face cap 94 in position overlying the receptacle face 90, face cap 94 is provided with a pair of projecting flanges 98, 98 integrally formed at opposite ends of the cap 94 in offset relation to the plane containing the front surface of face cap 94. Complementary recesses 100, 100 are formed in receptacle 16 adjacent opposite ends of its raised face 90 to provide supporting shelves for receiving the face cap flanges 98, 98. The receptacle face cap 94 is preferably formed of a tough, formsustaining material such as metal or a suitable plastic, e.g., Zytel-101 nylon which is a tough resilient material and has been found to perform satisfactorily.

Accordingly, receptacle face caps 94 may be formed, e.g., in an ivory color and supplied with standard black receptacles to be snapped easily over the face of a receptacle as desired when a receptacle color other than black is preferred, as an example, to identify those outlets in a group and which are controlled by a common switch.

Figure 4:
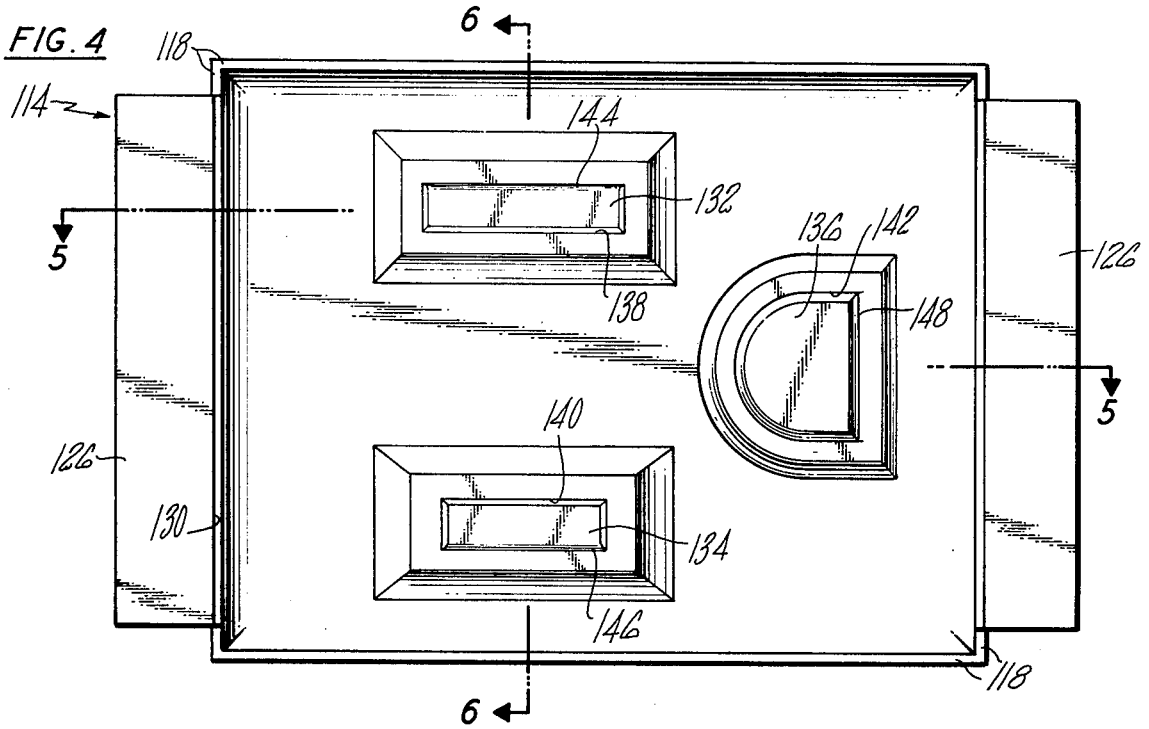
FIG. 4 is a bottom plan view of a receptacle face cap of this invention.
Figure 5:
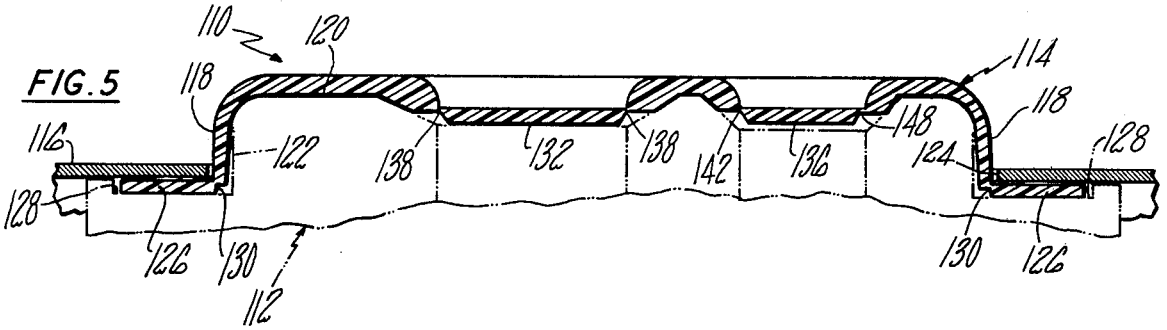
FIG. 5 is a section view taken along line 5—5 of FIG. 4.
Figure 6:
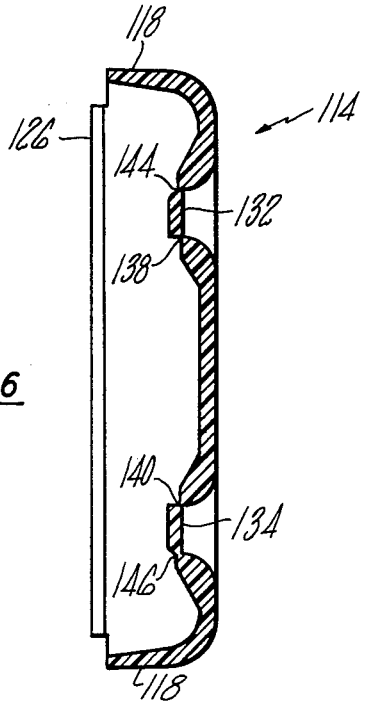
FIG. 6 is a section view taken along line 6—6 of FIG. 4.

Another embodiment of an electrical receptacle assembly 110 incorporating this invention is illustrated in FIGS. 4–6 as comprising a receptacle 112, an overlying face cap 114 and a cover plate 116. As in the above described embodiment of this invention, the receptacle face cap 114 is of a rectangular configuration, and a depending surrounding skirt 118 extends around the edges of the cap 114. Cap 114 is dimensioned and configured to fit in mating overlying relation to a raised face 120 of the receptacle 112 with the skirt 118 of cap 114 enclosing sidewalls 122 surrounding the face 120 of receptacle 112. Sufficient clearance is provided between opening 124 of cover plate 116 and sidewalls 122 of the raised receptacle face 120 to ensure that the receptacle cover plate opening 124 is registrable with the raised receptacle face 120 and, alternatively, with both face 120 and its overlying cap 114 when cap 114 is mounted in position on receptacle face 120 as illustrated in FIG. 5.

For securing cap 114 in overlying position on face 120 of receptacle 112, a pair of side flanges 126, 126 are shown integrally formed on cap 114 to project in opposite directions outwardly from the bottom of skirt 118. Flanges 126, 126 serve as retaining means for cap 114 when cover plate 116 is installed with the flanges 126, 126 interposed between receptacle 112 and cover plate 116. As in the previously described embodiment of face cap 94, recesses 128, 128 are provided in the receptacle 112 adjacent opposite ends of its raised face 120. Recesses 128 and 128 are located in corresponding relation to the projecting flanges 126 and 126 of cap 114 to serve as flange supporting shelves.

To permit quick and easy removal of the mounted face cap 114 from the receptacle 112 when desired, without requiring removal of cover plate 116, the material between each flange 126 and its adjoining portion of skirt 118 may be scored such as at 130 to provide a frangible connection. Such construction enables face cap 114 to be simply broken away from its flanges 126, 126 to expose receptacle face 120 while the receptacle 112 and cover plate 116 remain fixed in position.

To maintain the integrity of the assembly 110 and to minimize entry of undesired particles into receptacle 112, cap 114 of FIGS. 4–6 is shown as being an imperforate cap with pierceable or breakaway regions matching the plug prong-receiving openings in the underlying receptacle face 120. Accordingly, face cap 114 may be used as shown in FIGS. 4–6 as a dust cover or paint cover, for example.

In the specifically illustrated embodiment, the breakaway regions of the face cap include two rectangular areas 132, 134 and one arcuately configured area 136 having lines of weakness which in the illustrated embodiment, specifically correspond to the outer limits of the receptacle face openings (such as those shown at 92 in FIG. 1). These lines of weakness are illustrated at 138 and 140 as being in continuation with one another in their respective regions 132 and 134 (and defining three sides of each rectangular region) and at 142 defining the arcuate portion of region 136 for receiving a ground contact prong. Each of the regions 132, 134 and 136 are shown as having a linear interconnecting side hinge at 144, 146 and 148, joining their respective lines of weakness. It will also be understood that other arrangements are contemplated but not specifically illustrated, e.g., a breakaway region could be formed in the face cap 114 having a central line of weakness, generally corresponding to an underlying receptacle face opening, and extending between parallel interconnecting side hinges.

By virtue of the above described construction, upon thrusting the prongs of a plug into breakaway regions 132, 134 and 136, the face cap 114 will be perforated and the lines of weakness 138, 140 and 142 will be broken away from the surrounding material of the face cap 114 to permit entry of the prongs into the receptacle openings. The hinges 144, 146 and 148 of each region 132, 134 and 136 prevent separation of the material pierced from cap 114 and prevents lodging of that material in interfering relation between the electrical contacts, not shown, in the receptacle 112, and thereby ensures that the prongs are completely seated for good mechanical and electrical connection between the contacts of the receptacle 112.

The receptacle face cap 114 may be formed of any tough suitable form-sustaining material. Zytel-101 nylon has been found to perform satisfactorily as the material from which face cap 114 is made.

As will be apparent to persons skilled in the art, various modifications, adaptations and variations of the foregoing specific disclosure can be made without departing from the teachings of this invention.

I claim:

1. An electrical raceway assembly comprising an elongated channel-shaped cover having a cover plate with a pair of projecting sidewalls forming longitudinally extending free edges, the cover plate having spaced receptacle openings, one of the sidewalls having its free edge bent toward the other sidewall to form a conductor retaining jaw, and a plurality of receptacles mounted within the cover in spaced relation corresponding to the receptacle openings in the cover plate, the receptacles each having a recess extending along one side thereof in adjacent confronting relation to the conductor retaining jaw of said one sidewall, thereby providing a by-pass conductor compartment which cooperates with the conductor retaining jaw for controlled retention of a by-pass conductor between the receptacles and said one sidewall of the cover during raceway installation.

2. The assembly of claim 1 wherein the cover is formed of a resilient form-sustaining material.

3. The assembly of claim 1 wherein said one sidewall of the cover has an external groove longitudinally extending adjacent its free edge, the free edge of said one sidewall being in reversely bent relation to the groove and forming said conductor retaining jaw.

4. The assembly of claim 3 wherein the groove in said one sidewall of the cover forms an interior sidewall projection, and wherein the receptacles each have a retaining rib projecting from one side of the receptacle to be snapped under the interior sidewall projection for retaining the cover and each receptacle in assembly with the receptacles pressed against the cover plate.

5. The assembly of claim 4 wherein the receptacles each have a ledge formed along said one side of each receptacle in spaced parallel relation to its retaining rib, the recess along each receptacle being located between its retaining rib and ledge and defining said by-pass conductor compartment.

6. The assembly of claim 1 wherein the other of the cover sidewalls has its free edge bent toward said one sidewall to form a pair of conductor retaining jaws, wherein the receptacles each have a second recess extending along a side of the receptacle opposite said one side in adjacent confronting relation to the adjacent conductor retaining jaw, thereby providing a pair of by-pass conductor compartments cooperating respectively with the pair of conductor retaining jaws for controlled retention of a pair of by-pass conductors between each of the receptacles and the sidewalls of the cover.

7. The assembly of claim 6 wherein an elongated, channel-shaped base complementary to the cover is provided for snap-in assembly therewith, the base having a floor to be surface mounted on a support, the base having a pair of parallel sidewalls projecting respectively from opposite sides of the floor for snap-in engagement with the sidewalls of the cover, opposite sides of each receptacle having corners thereof removed adjacent the floor of the base, thereby providing clearance between each receptacle and two corners of the base for receiving two additional by-pass conductors.

8. The assembly of claim 1 wherein the receptacles each have a plug prong-receiving face, and wherein a receptacle face cap is provided with the cap being dimensioned and configured to removably fit onto the receptacle in overlying relation thereto, the face cap having retaining means projecting therefrom which when assembled is in interposed relation between the cover plate and the receptacle and serves to secure the face cap in overlying relation to the face of the receptacle.

9. An electrical raceway assembly comprising an elongated channel-shaped base, a matching cover of resilient form-sustaining material, the base having a floor to be surface mounted on a support, the cover having a cover plate with spaced receptacle openings, the base and cover each having parallel sidewalls projecting respectively from the floor and cover plate to form longitudinally extending free edges on the base and cover engageable in mating assembly, the free edges of the base sidewalls being bent toward one another to form a longitudinally extending tongue on each base sidewall, the cover sidewalls each having a longitudinally extending external groove adjacent its free edge, the free edge of each cover sidewall being reversely bent to form an exterior lead-in lip and an interior conductor retaining jaw, the groove in each cover sidewall forming an exterior tongue-receiving recess and an interior projection, and a plurality of receptacles corresponding in number to the cover receptacle openings, each receptacle having retaining ribs projecting from opposite sides of the receptacle to be snapped under the interior projections of the cover sidewalls for retaining the cover and receptacles in assembly with the receptacles each pressed against the cover plate for ease and convenience of installation, each receptacle having recesses extending along its opposite sides in parallel adjacent relation to its retaining ribs and in confronting relation respectively to the conductor retaining jaws on the interior cover sidewalls, thereby providing a pair of by-pass conductor compartments which cooperate with the conductor retaining jaws of the cover sidewalls for controlled retention of a pair of by-pass conductors between the receptacles and the sidewalls of the cover during raceway installation and cover snapin assembly with the base.

10. The assembly of claim 9 wherein opposite sides of each receptacle have corners thereof removed adjacent the floor of the base, thereby providing clearance between each receptacle and two corners of the base for receiving two additional by-pass conductors.

11. The assembly of claim 9 wherein the receptacles each have a raised face, the receptacle face having plug prong-receiving openings therein, and wherein a receptacle face cap is provided for each receptacle, the face cap being dimensioned and configured to removably fit onto the receptacle in overlying relation thereto, the face cap having plug prong-receiving openings, matching those in the receptacle face, and projecting flanges which, when assembled in interposed relation between the cover plate and the receptacle, serve to secure the face cap in overlying position on the face of the receptacle, the face cap being of a contrasting color relative to that of the face of the receptacle.

12. An electrical raceway assembly comprising a cover having a cover plate and a pair of sidewalls projecting from the cover plate, the cover plate having a receptacle opening, a receptacle mounted within the cover, the receptacle having a recess extending along one side of the receptacle in adjacent confronting relation to one of the sidewalls, the receptacle and said one sidewall of the cover cooperating to provide a by-pass conductor compartment for controlled retention of a by-pass conductor between the receptacle and said one sidewall of the cover, the receptacle having a raised plug prong-receiving face receivable within the receptacle opening, and a receptacle face cap dimensioned and configured to be removably mounted on the receptacle in overlying relation to its face, the face cap having flanges projecting therefrom which when assembled are in interposed relation between the cover plate and the receptacle and serve to secure the face cap in overlying relation to the face of the receptacle.

13. An electrical receptacle assembly comprising a receptacle having a plug prong-receiving face, a receptacle face cap dimensioned and configured to be mounted in fixed overlying relation to the receptacle face, and a receptacle cover plate having an opening registrable with the receptacle face and, alternatively, both the receptacle face and its overlying face cap, the face cap having retaining means projecting therefrom which when assembled is in interposed trapped relation between the cover plate and the receptacle and serves to secure the face cap against movement in fixed overlying relation to the face of the receptacle.

14. The assembly of claim 13 wherein the receptacle face cap is formed of a tough, resilient form-sustaining plastic.

15. The assembly of claim 13 wherein the exposed surface of the face cap is different in appearance from that of the face of the receptacle.

16. The assembly of claim 13 wherein the receptacle face includes plug prong-receiving openings, and wherein the face cap is imperforate and has breakaway regions therein matching the plug prong-receiving openings in the receptacle face, whereby the prongs of a plug may be thrust through the breakaway regions of the face cap and into the underlying plug prong-receiving openings in the receptacle face without requiring removal of the face cap from the receptacle.

17. The assembly of claim 16 wherein the breakaway regions in the face cap are defined by frangible lines of weakness generally corresponding to the plug prong-receiving openings in the receptacle face, and wherein the breakaway regions each include a hinge interconnecting the breakaway face cap material with the surrounding face cap material.

18. The assembly of claim 13 wherein the receptacle has a raised face and surrounding sidewalls, wherein the face cap has a depending skirt, and wherein the retaining means of the face cap comprises a pair of flanges projecting from the skirt for receipt between the receptacle and the cover plate to secure the face cap on the face of the receptacle.

19. The assembly of claim 18 wherein the projecting flanges of the face cap and its skirt are joined by a frangible connection to permit the face cap to be easily broken away from its flanges to expose the receptacle face without requiring removal of the cover plate.

20. The assembly of claim 18 wherein recesses are formed in the receptacle adjacent its sidewalls in offset relation to its raised face and providing supporting shelves for receiving the face cap flanges.

* * * * *

UNITED STATES PATENT AND TRADEMARK OFFICE

CERTIFICATE OF CORRECTION

PATENT NO. : 4,017,137

DATED : April 12, 1977

INVENTOR(S) : William E. Parks

It is certified that error appears in the above-identified patent and that said Letters Patent are hereby corrected as shown below:

Under OTHER PUBLICATIONS, wherein the word "Wildmold" should read --Wiremold--;

Column 3, line 3, wherein the word "through" should be in quotation marks;

Column 3, line 47, wherein the word "formsustaining" should read --form-sustaining--;

Column 6, line 51, wherein the word "snapin" should read --snap-in--.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*